US005561263A

United States Patent [19]

Baillod

[11] Patent Number: 5,561,263

[45] Date of Patent: Oct. 1, 1996

[54] DEVICE FOR CAPTURING HUMANS OR ANIMALS

[76] Inventor: Frederic Baillod, 1, Place du Tricentenaire, 2300 La Chaux-de-Fonds, Switzerland

[21] Appl. No.: 518,883

[22] Filed: Aug. 24, 1995

Related U.S. Application Data

[63] Continuation-in-part of Ser. No. 331,175, Oct. 28, 1994, abandoned.

[30] Foreign Application Priority Data

Nov. 1, 1993 [CH] Switzerland ..... 3287/93

[51] Int. Cl.[6] ..... F42B 12/68

[52] U.S. Cl. ..... 102/504; 102/483; 102/517; 89/1.34

[58] Field of Search ..... 102/371, 438, 102/439, 483, 501, 502, 504, 517; 42/105; 89/1.34; 273/84, 428

[56] References Cited

U.S. PATENT DOCUMENTS

| | | | |
|---|---|---|---|
| 30,869 | 12/1860 | Briggs | 102/371 |
| 34,626 | 3/1862 | Ely | 102/504 |
| 34,628 | 3/1862 | Gault | 102/504 |
| 39,282 | 7/1963 | Ganster . | |
| 276,090 | 4/1883 | Sperry | 102/504 |
| 502,713 | 8/1893 | Gathmann | 102/483 |
| 569,810 | 10/1896 | Carey | 102/504 |
| 981,357 | 1/1911 | Babbitt | 102/483 |
| 1,304,857 | 5/1919 | Davis . | |
| 1,309,530 | 7/1919 | Lamberson . | |
| 1,315,721 | 9/1919 | Hall | 102/504 |
| 1,343,747 | 6/1920 | Radakovich . | |
| 1,343,947 | 6/1920 | Radakovich | 102/504 |
| 1,488,182 | 3/1924 | Whelton . | |
| 1,536,164 | 5/1925 | Tainton | 102/504 |
| 2,455,784 | 12/1948 | Lapsensohn | 43/6 |
| 2,805,622 | 9/1957 | Cammin-Christy . | |
| 3,340,642 | 9/1967 | Vasiljevic | 102/504 |
| 3,583,087 | 6/1971 | Huebner . | |
| 4,166,619 | 9/1979 | Bergmann et al. | 273/106.5 B |
| 4,327,644 | 5/1982 | Stancil . | |
| 4,559,737 | 12/1985 | Washington . | |
| 4,664,034 | 5/1987 | Christian . | |
| 5,003,886 | 4/1991 | Pahnke et al. . | |
| 5,099,747 | 3/1992 | Smith | 102/504 |
| 5,315,932 | 5/1994 | Bertram . | |

FOREIGN PATENT DOCUMENTS

| | | | |
|---|---|---|---|
| 491876 | 6/1919 | France . | |
| 533475 | 3/1922 | France | 102/504 |
| 565156 | 1/1924 | France . | |
| 805306 | 11/1936 | France . | |
| 918204 | 2/1947 | France . | |
| 92 14 515.9 | 1/1993 | Germany . | |
| 93 08 186.3 | 9/1993 | Germany . | |
| 103500 | 1/1917 | United Kingdom | 102/504 |
| 107253 | 6/1917 | United Kingdom | 102/504 |

*Primary Examiner*—Harold J. Tudor
*Attorney, Agent, or Firm*—Young & Thompson

[57] ABSTRACT

A device for capturing humans or animals, comprises a pair of projectiles each having a forward head and a rear shank. Each shank is semi-cylindrical and offset to one side of its associated head, such that when the projectiles are placed together with their shanks contiguous to each other, the two shanks together form a cylindrical body and the two heads together form a flattened body disposed in a plane perpendicular to a mating plane of the two shanks. A flexible tether interconnects the two projectiles, whereby when the two shanks are disposed contiguous to each other and inserted in the bore of the barrel of a firearm, and the firearm is fired, the two shanks will impart thrust to their respective projectiles along lines of force disposed to one side of a center of gravity of each projectile. These centers of gravity are thus disposed on opposite outward sides of those lines of thrust and lie in the plane of the flattened body, whereby when the device leaves the firearm, the projectiles will diverge to extend the tether between them in the plane of the flattened body. Hooks are carried by the heads for retarding disengagement of the device from a captured human or animal. The hooks have shanks extending through the heads whereby the hooks are slidable forwardly and rearwardly relative to the heads. When the device is launched, the hooks occupy a retracted position, but slide to an extended position by inertia when the device is stopped by a captured human or animal.

5 Claims, 4 Drawing Sheets

DEVICE FOR CAPTURING HUMANS OR ANIMALS

This application is a continuation-in-part of my application Ser. No. 08/331,175, filed Oct. 28, 1994, now abandoned.

FIELD OF THE INVENTION

The present invention relates to a device for capturing humans or animals, by encircling the same with a flexible cord.

BACKGROUND OF THE INVENTION

It is known no capture animals or humans by firing in the direction of the subject a pair of projectiles interconnected by a flexible member, the projectiles diverging from each other and causing the flexible member to wrap around the subject to capture the same. Examples of such devices are disclosed in U.S. Pat. Nos. 4,559,737 and 5,315,932.

Such devices are complicated to make and not always reliable to use.

OBJECTS OF THE INVENTION

Accordingly, it is an object of the present invention to provide a device for capturing animals or humans, which reliably fires two projectiles interconnected by a tether, in such a way as to capture the object without injuring the same.

Another object of the present invention is the provision of such a device, in which the plane of flight of the two projectiles can be reliably restricted to horizontal, thereby to encircle an upright object such as a human or an animal.

Still another object of the present invention is the provision of such a device which can be fired from a conventional firearm using a blank cartridge for propulsion.

Finally, it is an object of the present invention to provide such a device, which will be simple and inexpensive to manufacture, easy, safe and reliable to employ, and rugged and durable in use.

SUMMARY OF THE INVENTION

These and other objects of the present invention are achieved, by providing a device for capturing humans and animals, in which two projectiles are employed each of which has a forwardly directed enlarged flattened head and a rearwardly projecting shank. The two shanks together form a cylinder adapted to be received in the bore of a conventional firearm adapted to fire blanks. A line of thrust is thus established along each shank. This line of thrust is on the inward side of the center of gravity of each projectile, thanks to the outwardly extending mass of the enlarged flattened head. As a result, when the projectiles are simultaneously projected by a blank cartridge, they will tend to diverge because the centers of gravity will be on opposite outward sides of the lines of thrust of the shafts. The projectiles will thus diverge from each other in the same common plane as contained their flattened heads prior to firing. The plane of flight of the device can thus be predetermined and will of course ordinarily be selected to be horizontal.

The projectiles can carry hooks which normally are recessed within the projectiles but which, upon the projectiles being suddenly stopped by the captured object, extend due to their inertia and so catch in the clothing of a person or the skin of an animal, thereby to impede unwinding of the tether from about the captured object.

BRIEF DESCRIPTION OF THE DRAWINGS

These and other features of the present invention will become apparent from a consideration of the following description, taken in connection with the accompanying drawings, in which.

DETAILED DESCRIPTION OF THE INVENTION

Figure 1:
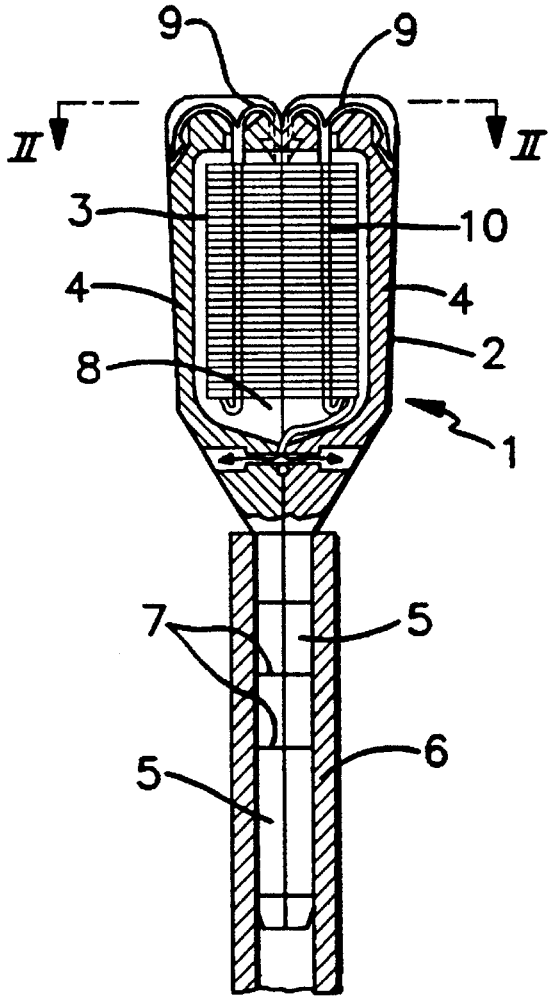
FIG. 1 is a plan view, with parts broken away, of a device according to the present invention in firing position in the barrel of a conventional firearm.
Figure 2:
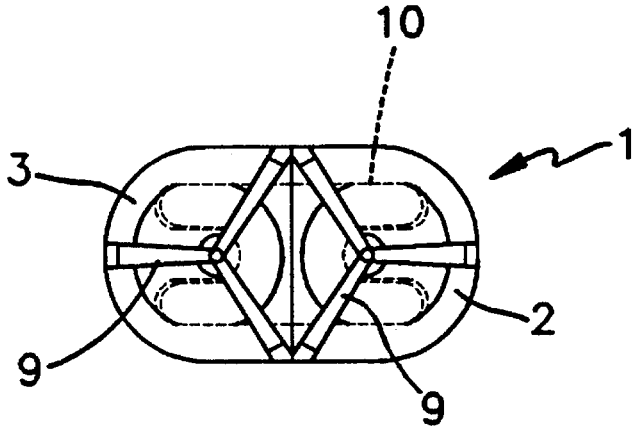
FIG. 2 is a cross-sectional view on the line 2—2 of FIG. 1.

Referring now to the drawings in greater detail, and first with reference to FIG. 1 thereof, there is shown a device for capturing humans and animals according to the present invention, indicated generally at 1, and comprising a pair of projectiles 2 and 3 disposed side by side, which projectiles are mirror images of each other. Each such projectile has a head 4 and a shank 5, the head 4 being enlarged relative to shank 5 and flattened, as seen in FIG. 2, in a single plane, there being a common plane of symmetry along which the two projectiles 2 and 3 meet.

Each shank 5 is a semi-cylinder; and together, the two shanks 5 form a cylinder of a diameter adapted to be slidably received in the bore of the barrel of a conventional firearm 6. The projectiles 2 and 3 are thus adapted to be launched by the percussive force of a blank cartridge in the firearm 6, against the free ends of shanks 5, in the same manner as a conventional rifle grenade.

Shanks 5 are provided with transverse marks 7 thereon, so that the depth of insertion of shanks 5 in the barrel of firearm 6 can be selected, according to the impulse it is desired to impart to the device, that is, according to the distance to the object to be captured.

Figure 3:
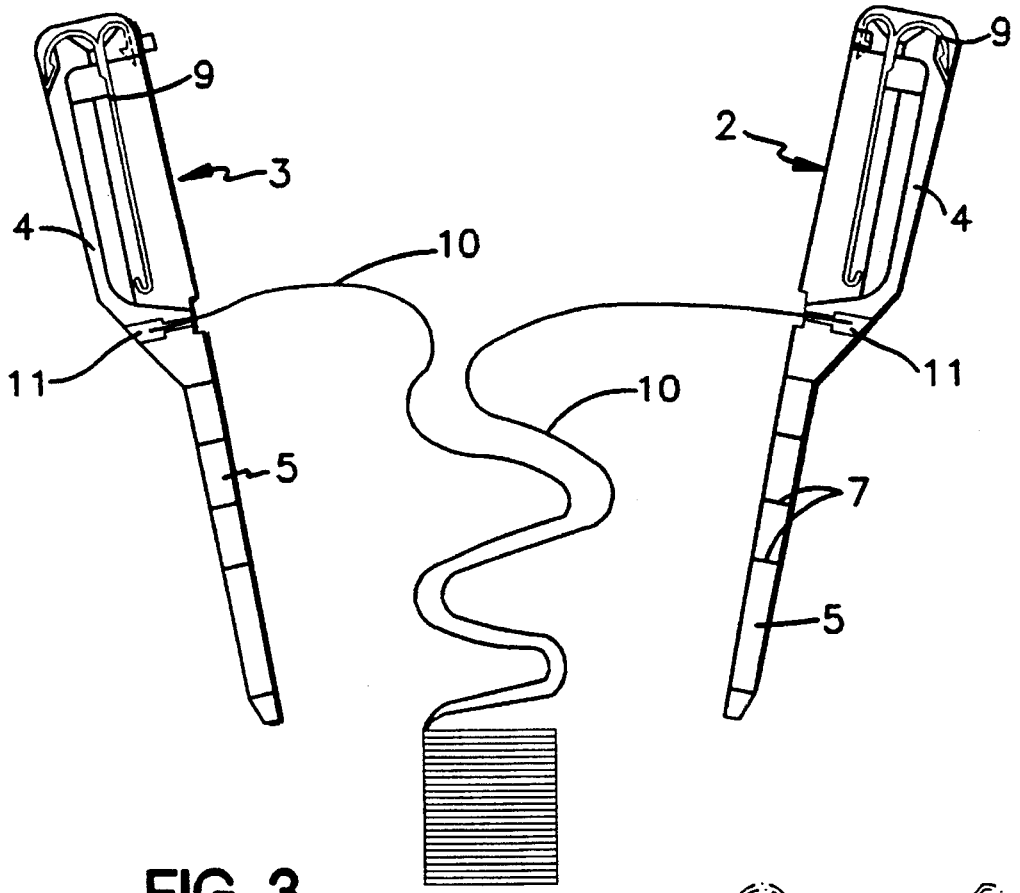
FIG. 3 is a view similar to FIG. 1 but showing the device immediately after launching, wherein the two projectiles have begun to diverge.
Figure 4:
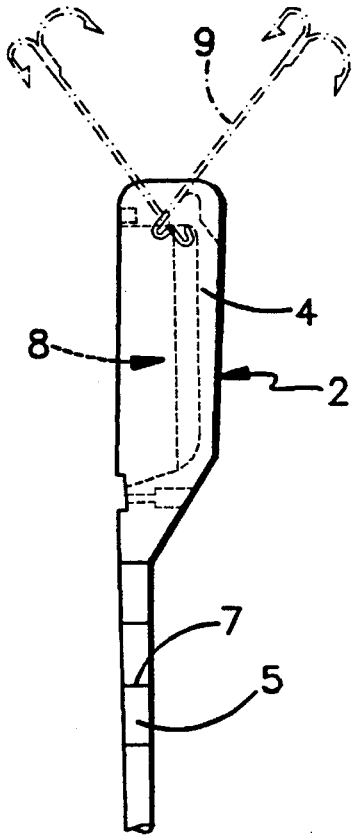
FIG. 4 is a view of one of the projectiles, showing in phantom line the possible extended positions of the hook.

Each head 4 has a laterally open cavity 8 therein, the two cavities 8 confronting each other and forming a single enlarged cavity when the two projectiles 2 and 3 are disposed side by side in launching position. Disposed within each cavity 8 is the shank of a hook 9, the hook being adapted to slide through the forward end of the head 4 between a retracted position as seen in FIG. 3, and an extended position as seen in FIG. 4. In the retracted position, the barbs of hook 9 are received within recesses in the forward end of the head 4, as shown in FIGS. 1 and 3, thereby to make the device safe to handle prior to launching.

The two projectiles 2 and 3 are interconnected by a tether in the form of a flexible strong cord of nylon or the like, each end of which is secured in a recess 11 in a respective one of the projectiles 2 and 3, so that the cord 10 inseparably connects the two projectiles together in the sense that the two projectiles can move apart from each other but will be inseparably tethered together by cord 10. Cord 10 is wound or folded into the common cavity provided by the two confronting cavities 8 when the two projectiles 2 and 3 are together in launching position, as shown in FIGS. 1 and 2 of the drawings.

In use, the two projectiles 2 and 3 in confronting relationship are inserted in the barrel of the firearm 6 as seen in FIG. 1, the shanks entering the barrel of the firearm to a depth that can be predetermined by observing the marks 7. As shown in FIG. 1, the device is at maximum depth in the barrel, for maximum range.

Prior to firing, the user ensures that the common plane of the flattened heads 4 is horizontal. This will ensure that the device moves in a horizontal plane (apart from its arcuate trajectory), so that the device will wrap around an upright object such as a human or the legs of an animal.

Upon firing the blank cartridge, the impulse of the explosion is borne by the rear ends of the shanks 5. This establishes a line of thrust lengthwise of those shanks. But because that line of thrust is eccentric to the center of gravity of the device, each projectile 2 or 3 will tend to veer in the direction in which the center of gravity is displaced from the associated line of thrust, once the shanks 5 have cleared the firearm barrel.

Because of the configuration of the heads 4, flattened and extending laterally outwardly beyond each respective shank 5, the respective centers of gravity will be on opposite outward sides of the lines of thrust. This means that as soon as the shanks 5 clear the firearm barrel, the heads 4 will diverge in the same plane in which their flattened heads 4 were initially disposed at the moment of firing.

The tether 10 is only loosely disposed in the confronting cavities 8 and so does not impede the divergence of the projectiles 2 and 3 until the tether is fully extended. In this extended condition, the tether makes a substantially horizontal sweep of the target area and so will strike any upright object such as an animal or a human disposed in the target area.

Upon striking the object, the tether stops but the projectiles continue and so quickly wrap around the target object until, upon striking the object, the projectiles are abruptly brought to a stop.

When the projectiles thus abruptly stop, the hooks 9, which had been in the retracted FIG. 3 position, slide under the impulse of their inertia to an extended position as shown in FIG. 4. Should the human or animal attempt to unwind the device, these hooks will catch in the clothing of the human or the skin of the animal and impede this unwinding.

Figure 5:
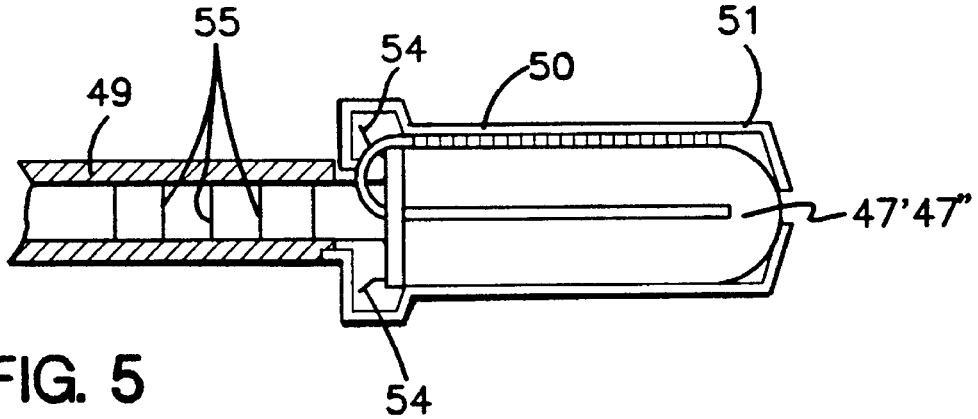
FIG. 5 is a cross-sectional view of a modified form of device according to the present invention.
Figure 6:
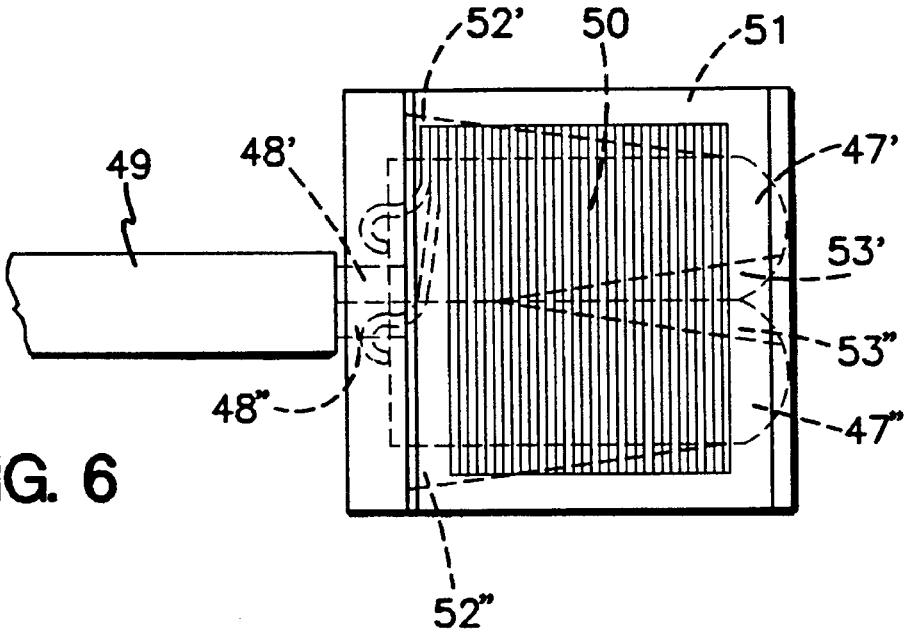
FIG. 6 is a top plan view of the modification shown in FIG. 5.

FIGS. 5 and 6 show a second embodiment of the device for capturing. Referring to these figures, the projectile 47 is comprised of two symmetrical components including each one a projectile head 47', 47" fastened to a base 48', 48" From these bases 48', 48", extends a semi-cylindrical shank designed for introduction into the end of the barrel 49 of a firearm such as a revolver or a pistol. The propelling of the projectile is ensured by a blank cartridge. The two projectiles 47', 47" are connected together by a flexible tether 50. One of the ends of this tether 50 is fastened to the base 48', while the other end of the tether 50 is fastened to the base 48". The tether 50 is wound around the projectiles 47', 47" without surrounding them, as is apparent from FIG. 5. A casing 51, generally made of cardboard or of plastic, surrounds and holds side by side the two half projectiles 47', 48', 47", 48". This casing has an opening at the end opposite to the barrel of the firearm, which facilitates its separation when the shot is fired. The heads of the projectiles 47', 47" are provided respectively with outer fins 52', 52" and inner fins 53', which assist in the separation of the two half projectiles 47', 47", 48', 48" in flight. When the shot is fired, the casing 51 is torn and falls in front of the barrel, and the projectiles 47', 47", 48', 48" tend to separate from each other in opposite directions in the horizontal plane until the tether 50 connecting them is fully extended. At the instant of the impact, the central part of the tether 50 will touch the subject and due to the inertia of the half projectiles 47', 48' and 47", 48", the tether will surround and immobilize the subject. One will note furthermore the presence of projectiles or of hooks 54 fastened to the ends of the projectiles. These hooks 54 are designed for clinging to the clothes or on the skin of the subject being captured, thus preventing an easy release. Marks 55 are made by any appropriate means on the semi-cylindrical shanks extending from the bases 48', 48". These marks 55 act as reference marks and enable to adjust the introduction of the shanks into the barrel. It is hence possible, by introducing the shanks of the projectiles more or less deeply into the barrel 49 of the firearm, to adjust the firing distance.

Figure 7:
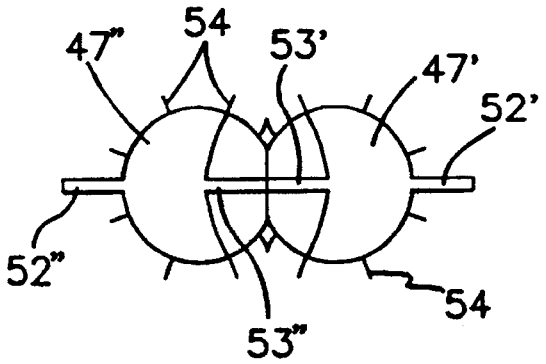
FIG. 7 is an end view of the device of FIGS. 5 and 6.

FIG. 7 is an end view of the two half projectiles 47', 47" without their protective casing 51.

Figure 8:
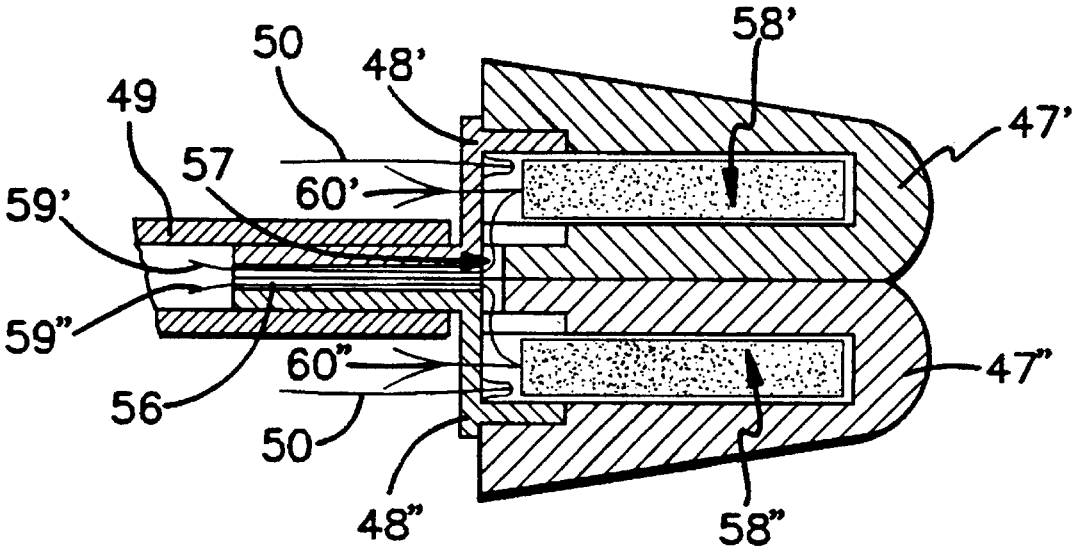
FIGS. 8 and 9 are views similar to FIG. 6 but of further modified embodiments of the present invention.

FIG. 8 shows another version of the projectile shown in FIG. 5. This projectile is also comprised of two half projectiles carrying each one a head 47', 47" fastened to a base 48', 48". The bases 48' and 48" receive each one the end of a flexible tether 50. A channel 56 is provided at the center of the rod formed of two half rods extending from bases 48', 48". This channel 56 opens at one of its ends into the barrel 49 of the firearm and at its other end into a recess 57 located at the point where the heads 47', 47" meet the bases 48', 48". This recess 57 is in communication with the cavities 58', 58" in the heads of the projectiles 47', 47". A charge of gunpowder or a rocket fills the cavities 58', 58" of each half projectile. Fast burning fuses 59', 59" are in contact with the charges of gunpowder at one of their ends and extend into the barrel 59 of the firearm, via channel 56. Thus, the firing of the shot ignites the fast burning fuses 59', 59' to cause the combustion of the powder or the firing of the rockets contained in the cavities 58', 58". Circular orifices of a small diameter 60', 60" are provided in the bases 48', 48" of the half projectiles and allow the evacuation of the combustion gases from the charges located in the cavities 48', 48". This version offers the advantage of increasing the encircling of the subject at the impact which is caused not only by the inertia of the half projectiles, but also by the thrust generated by the combustion of the powder charges.

Figure 9:
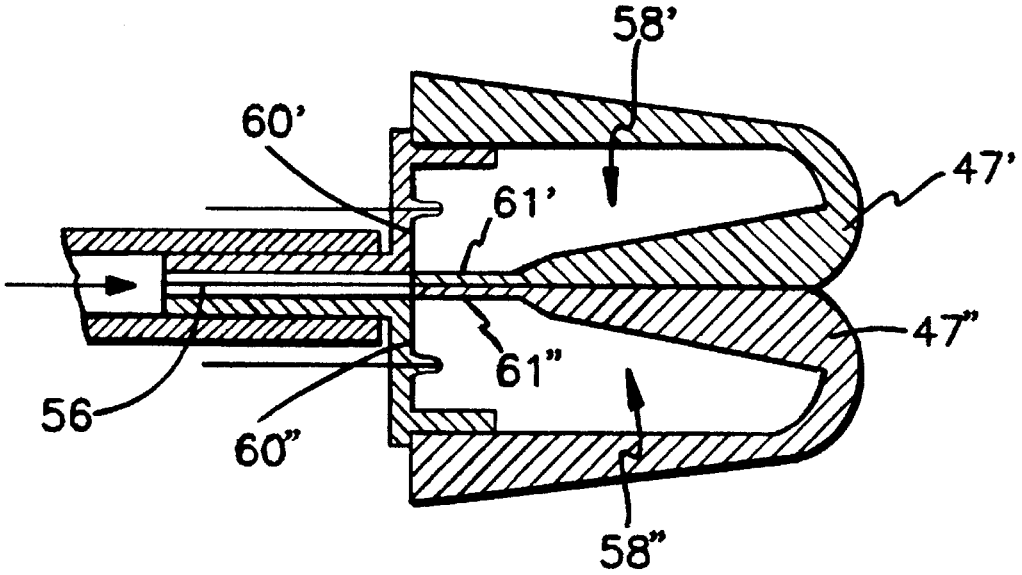

FIG. 9 shows yet another version of the projectile shown in FIG. 5. In this version, the channel 56 communicates via the passages 61', 61" with the cavities located in the heads 47', 47". In this version, the explosion of the charge of propellant causes a high pressure in the cavities 58', 58". The high pressure thus generated in the cavities produces a thrust as the gases escape through the orifices 60', 60", which increases the inertial effect at the instant of the impact when the subject is encircled by the two half projectiles.

In all the embodiments described above, the flexible tethers connecting the components which form the projectile can include gripping members having for their purpose to cling to the clothes or the skin of the subject after the projectile has encircled him, which increases accordingly his difficulty to free himself from the projectile. These members can be provided as hooks or the like, fastened by any appropriate means and spaced along the flexible tether. In the case of a wire used as the flexible tether, these members can be protrusions such as those found on conventional barbed wire.

It is obvious that none of the embodiments described above are of a limiting nature and that they can receive all manners of modifications desirable within the scope of the appended claims.

I claim:

1. Device for capturing humans or animals, comprising a pair of projectiles each having a forward flattened head and a rear shank, each shank being semi-cylindrical and offset to one side of its associated head, said projectiles constructed and arranged to occupy a firing position wherein the shanks of the projectiles are contiguous to each other, and together form a cylindrical body and the two flattened heads together form a flattened body disposed in a plane perpendicular to a mating plane of the two shanks, and a flexible tether interconnecting the two projectiles, whereby when the two shanks are disposed contiguous to each other and inserted in the bore of the barrel of a firearm, and the firearm is fired, the two shanks will impart thrust to their respective projectiles along lines of thrust disposed to one side of a center of gravity of each projectile, said centers of gravity being disposed on opposite outward sides of said lines of thrust whereby when the device leaves the firearm, the projectiles will diverge to extend said tether between them in said plane of said flattened body.

2. A device as claimed in claim 1, wherein said heads have confronting cavities when said projectiles are juxtaposed, and said tether is disposed in said confronting cavities.

3. A device as claimed in claim 1, further including hooks carried by said heads for retarding disengagement of said device from a captured human or animal.

4. A device as claimed in claim 3, wherein said hooks have shanks extending through said heads whereby said hooks are slidable forwardly and rearwardly relative to said heads, said hooks when the device is launched occupying a retracted position and sliding to an extended position by inertia when said device is stopped by a captured human or animal.

5. A device as claimed in claim 4, wherein said heads have recesses therein for protectively receiving said hooks when said hooks are in said retracted position.

* * * * *